US010314456B2

(12) United States Patent
Thiyagarajan et al.

(10) Patent No.: US 10,314,456 B2
(45) Date of Patent: Jun. 11, 2019

(54) DISHWASHING APPLIANCE AND METHODS OF OPERATION

(71) Applicant: Haier US Appliance Solutions, Inc., Wilmington, DE (US)

(72) Inventors: Ramasamy Thiyagarajan, Louisville, KY (US); Adam Hofmann, Louisville, KY (US); Matthew Mersch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 78 days.

(21) Appl. No.: 15/273,761

(22) Filed: Sep. 23, 2016

(65) Prior Publication Data

US 2018/0084966 A1 Mar. 29, 2018

(51) Int. Cl.
*A47L 15/42* (2006.01)
*A47L 15/00* (2006.01)

(52) U.S. Cl.
CPC ..... *A47L 15/0018* (2013.01); *A47L 2401/14* (2013.01)

(58) Field of Classification Search
CPC ..... A47L 15/0021; A47L 15/0023; A47L 15/0031; A47L 15/4244; A47L 15/4297; A47L 2401/06; A47L 2401/09; A47L 2401/14
See application file for complete search history.

(56) References Cited

U.S. PATENT DOCUMENTS

| | | | | |
|---|---|---|---|---|
| 3,835,880 | A | 9/1974 | Hoffman et al. | |
| 5,439,019 | A * | 8/1995 | Quandt | D06F 39/088 137/2 |
| 5,920,955 | A * | 7/1999 | Berfield | A47L 7/0028 15/321 |
| 6,790,290 | B2 | 9/2004 | Durfee | |
| 2002/0129650 | A1* | 9/2002 | Zimmermann | G01F 15/022 73/295 |
| 2006/0237036 | A1 | 10/2006 | Picardat et al. | |
| 2010/0175718 | A1 | 7/2010 | Kedjierski et al. | |

* cited by examiner

*Primary Examiner* — David G Cormier
(74) *Attorney, Agent, or Firm* — Dority & Manning, P.A.

(57) ABSTRACT

A dishwashing appliance, including methods of operation, is provided. The dishwashing appliance may define a vertical direction and include a tub, a base conductivity sensor mounted at a first level within the tub, and an elevated conductivity sensor mounted at a second level within the tub, the second level being higher along the vertical direction than the first level.

10 Claims, 12 Drawing Sheets

DISHWASHING APPLIANCE AND METHODS OF OPERATION

FIELD OF THE INVENTION

The present subject matter relates generally to dishwashing appliances, and more particularly to methods for controlling filling and draining of a wash fluid within dishwashing appliances.

BACKGROUND OF THE INVENTION

Dishwasher appliances or dishwashers generally include a tub that defines a wash chamber. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Conventional dishwashers have a water supply valve, such as a solenoid valve for filling the tub with water. An average or typical flow rate through a model water supply valve may be premeasured to provide a reference value for multiple assembled dishwashers. When those dishwashers operate to fill their respective tubs, water filling is controlled by time and the premeasured reference value of flow rate. Nonetheless, variations in individual water supply valves may occur, e.g., due to manufacturing tolerances and/or wear. The premeasured reference value may not exactly match the flow rate through the water supply valve of each assembled dishwasher. In order to accommodate variations in assembled water supply valves, dishwashers may be configured to open the water supply valve for longer than would otherwise be necessary. This may lead to an excessive amount of water (e.g., 0.1 gallon) being added for each filling or wash cycle. Moreover, it may lead to higher water consumption and operating costs for the dishwasher.

Conventional dishwashers may also have one or more drain pumps to remove water from the tub. Before assembly, one or more average or typical flow rates through a model drain pump may be premeasured to provide reference values for multiple assembled dishwashers. In turn, draining may be done by time based on the premeasured reference values of flow rates. However, variations in individual drain pumps may also occur, e.g., due to manufacturing tolerances and/or wear. In order to accommodate variations, dishwasher may be configured to operate a drain pump for longer than would otherwise be necessary. This may lead to an excessive drain pump operation, generating undesirable noise and costs. Moreover, it may complicate the dishwasher's ability to drain only a specific amount of water that might otherwise be used in later wash cycles or steps.

Accordingly, it would be advantageous to provide a dishwashing appliance that can accurately and consistently supply and/or drain a select amount of water.

BRIEF DESCRIPTION OF THE INVENTION

Aspects and advantages of the invention will be set forth in part in the following description, or may be obvious from the description, or may be learned through practice of the invention.

In one aspect of the present disclosure, a method of controlling a dishwashing appliance is provided. The dishwashing appliance may define a vertical direction and include a tub, a base conductivity sensor mounted at a first level within the tub, and an elevated conductivity sensor mounted at a second level within the tub, the second level being higher along the vertical direction than the first level. The method may include initiating a flow of wash fluid into the tub, receiving a signal from the base conductivity sensor in response to wash fluid at the base conductivity sensor, receiving a signal from the elevated conductivity sensor in response to wash fluid at the elevated conductivity sensor, measuring a time period between the signal from the base conductivity sensor and the signal from the elevated conductivity sensor, determining a volumetric flow rate for the flow of wash fluid based on the measured time period, and adjusting the flow of wash fluid into the tub based on the determined volumetric flow rate.

In another aspect of the present disclosure, a method of controlling a dishwashing appliance is provided. The dishwashing appliance may define a vertical direction and include a tub, a base conductivity sensor mounted at a first level within the tub, and an elevated conductivity sensor mounted at a second level within the tub, the second level being higher along the vertical direction than the first level. The method may include initiating a drain flow of wash fluid from the tub, receiving a signal from the top conductivity sensor in response to a conductivity break at the top conductivity sensor when wash fluid falls below the upper level within the sump portion, receiving a signal from the middle conductivity sensor in response to a conductivity break at the middle conductivity sensor when wash fluid falls below the intermediate level within the sump portion, and adjusting the drain flow of wash fluid from the tub in response to the signal from the middle conductivity sensor.

In yet another aspect of the present disclosure, a dishwashing appliance is provided. The dishwashing appliance may define a vertical direction and include a tub, a sump, a fluid circulation assembly, and a fluid sensor assembly. The tub may define a wash chamber for receipt of articles for washing. The sump may be positioned at a bottom portion of the tub along the vertical direction. The sump including an internal wall defining a collection chamber. The fluid circulation assembly may provide a flow of wash fluid within the wash chamber. The fluid sensor assembly may be disposed within the sump. The fluid sensor assembly may include an isolated sensor enclosure defining a detection cavity in fluid communication with the collection chamber, a base conductivity sensor mounted at a first level within the isolate sensor enclosure, and an elevated conductivity sensor mounted at a second level within the isolated sensor enclosure, the second level being higher along the vertical direction than the first level.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
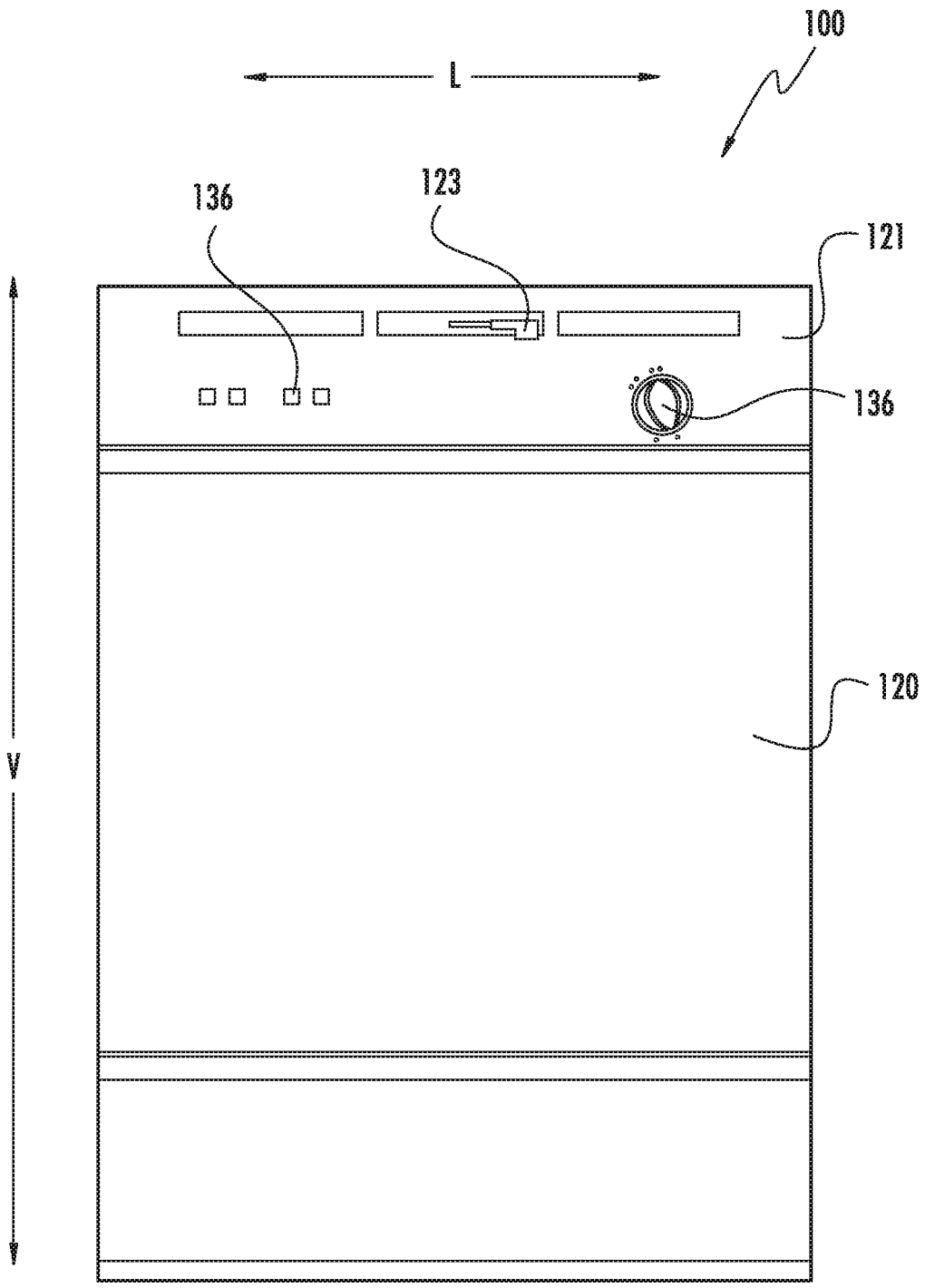
FIG. 1 provides a front view of a dishwasher appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure may provide a dishwasher appliance and method of operation that can accurately determine or predict the level of wash fluid within a tub portion of the dishwasher appliance. The dishwasher appliance may include multiple conductivity sensors that are mounted at different heights. As wash fluid fills (or is drained from) the tub, the time taken to reach two conductivity sensors may be used to estimate the current fill rate or drain rate. Certain conductivity sensors may additionally or alternatively serve to signal the drain appliance when filling/draining operations should be halted.

Figure 2:
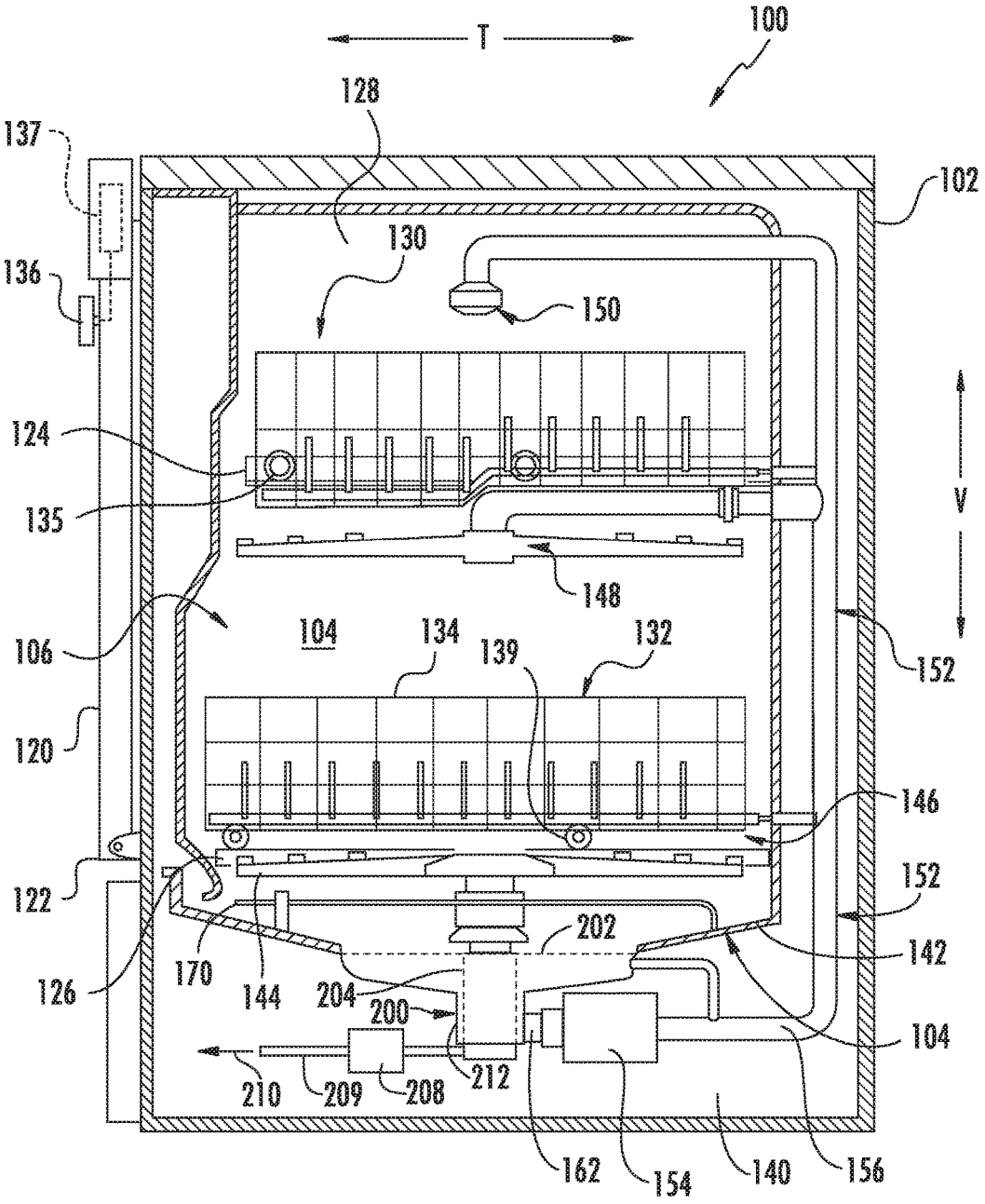
FIG. 2 provides a side view of the exemplary dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 123 is used to lock and unlock door 120 for access to wash chamber 106.

Upper and lower guide rails 124, 126 are mounted on tub side walls 128 and accommodate roller-equipped rack assemblies 130 and 132. In optional embodiments, each of the rack assemblies 130, 132 is fabricated into lattice structures including a plurality of elongated members 134 (for clarity of illustration, not all elongated members forming assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. In exemplary embodiments, such as the embodiment of FIGS. 1 and 2, one or more elevated spray assemblies 148, 150 are provided above the lower spray-arm assembly 144. For instance, a mid-level spray-arm assembly 148 is located in an upper region of the wash chamber 106 and may be located in close proximity to upper rack 130. Additionally or alternatively, an upper spray assembly 150 may be located above the upper rack 130.

The lower and mid-level spray-arm assemblies 144, 148 and the upper spray assembly 150 are part of a fluid circulation assembly 152 for circulating a wash fluid, such as water and/or dishwasher fluid, in the tub 104. In turn, fluid circulation assembly 152 may provide a flow of wash fluid within the wash chamber 106. For instance, fluid circulation assembly 154 includes a water inlet hose 172 in fluid communication with the wash chamber 106 (e.g., through bottom wall and/or sidewall of tub 104) to supply water thereto, as generally recognized in the art. The sump portion 142 may thus be filled with water through a fill port 175 that outlets into wash chamber 106. A water supply valve 174 may be provided to control water to the wash chamber 106. Water supply valve 174 may have a hot water inlet 176 that receives hot water from an external source, such as a hot water heater and a cold water input 178 that receives cold water from an external source. It should be understood that the term "water supply" is used herein to encompass any manner or combination of valves, lines or tubing, housing, and the like, and may simply comprise a conventional hot or cold water connection.

The fluid circulation assembly 152 also includes a recirculation pump 154 positioned in a machinery compartment 140 located below the tub sump portion 142 (i.e., below a bottom wall) of the tub 104, as generally recognized in the art. The recirculation pump 154 receives fluid from sump 142 to provide a flow to assembly 152, or optionally, a switching valve or diverter (not shown) may be used to select flow. A heating element 170 can be used to provide heat during, e.g., a drying cycle.

Each spray-arm assembly 144, 148 includes an arrangement of discharge ports or orifices for directing washing fluid received from the recirculation pump 154 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of the spray assembly 150 using fluid from the recirculation pump 154 provides coverage of dishes and other dishwasher contents with a washing spray. Other configurations of spray assemblies may be used as well.

In some embodiments, the dishwasher appliance 100 is further equipped with a controller 137 to regulate operation of the dishwasher appliance 100. The controller 137 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. For certain embodiments, the instructions include a software package configured to operate appliance 100 and, e.g., execute the exemplary methods 1200, 1300, and/or 1400 described below with reference to FIGS. 12 through 14. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 137 may be positioned in a variety of locations throughout dishwasher appliance 100. In the illustrated embodiment, the controller 137 may be located within a control panel area 121 of door 120 as shown in FIGS. 1 and 2. In some such embodiments, input/output ("I/O") signals may be routed between the control system and various operational components of dishwasher appliance 100 along one or more wiring harnesses that may be routed through the bottom 122 of door 120. Optionally, the controller 137 includes a user interface panel/controls 136 through which a user may select various operational features and modes and monitor progress of the dishwasher appliance 100. In exemplary embodiments, the user interface 136 may represent a general purpose I/O ("GPIO") device or functional block. For instance, the user interface 136 may include input components, such as one or more of a variety of electrical, mechanical, or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

Figure 4:
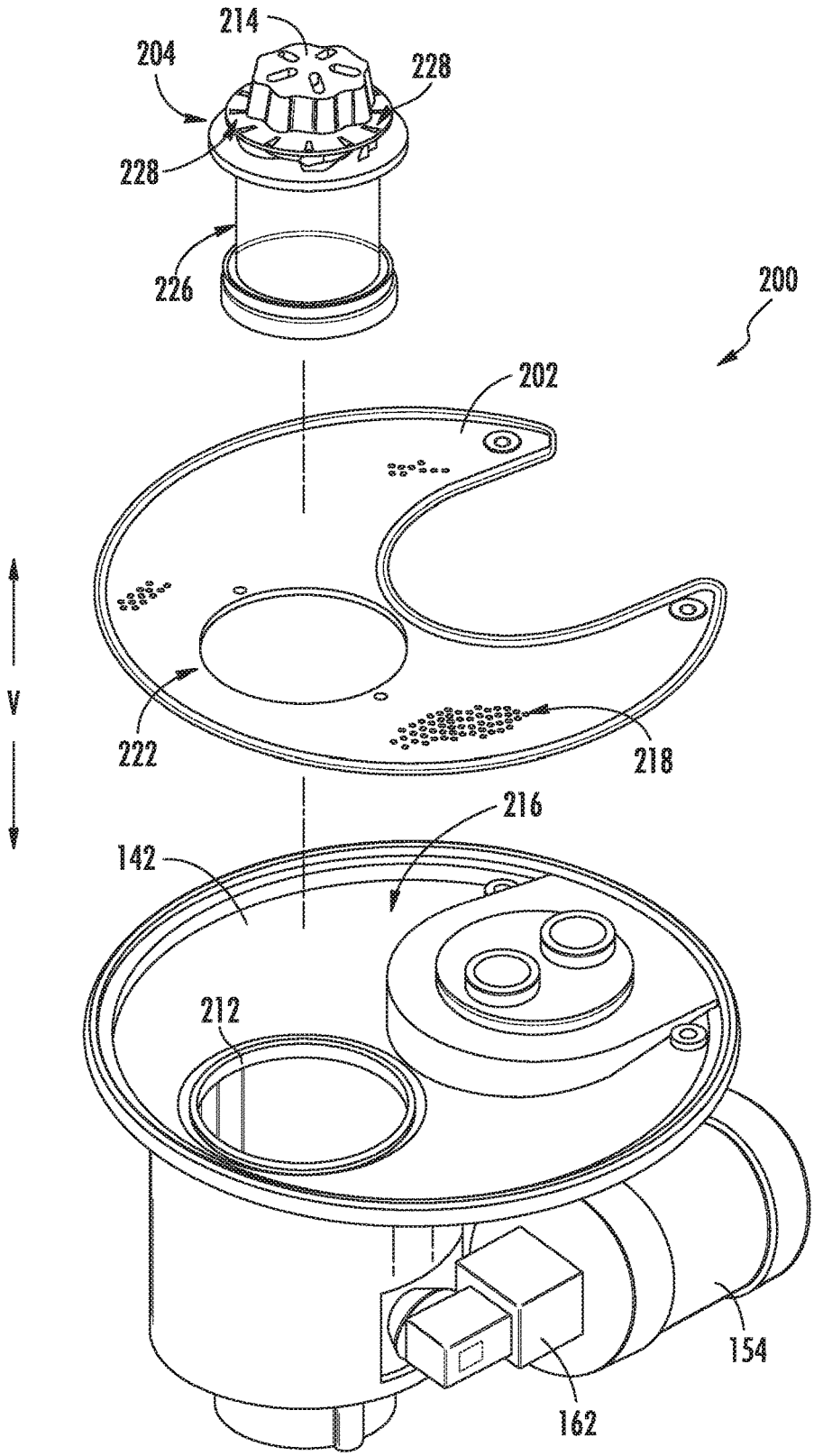
FIG. 4 provides an exploded view of a portion of the filter system of the exemplary dishwasher appliance of FIG. 2.
Figure 5:
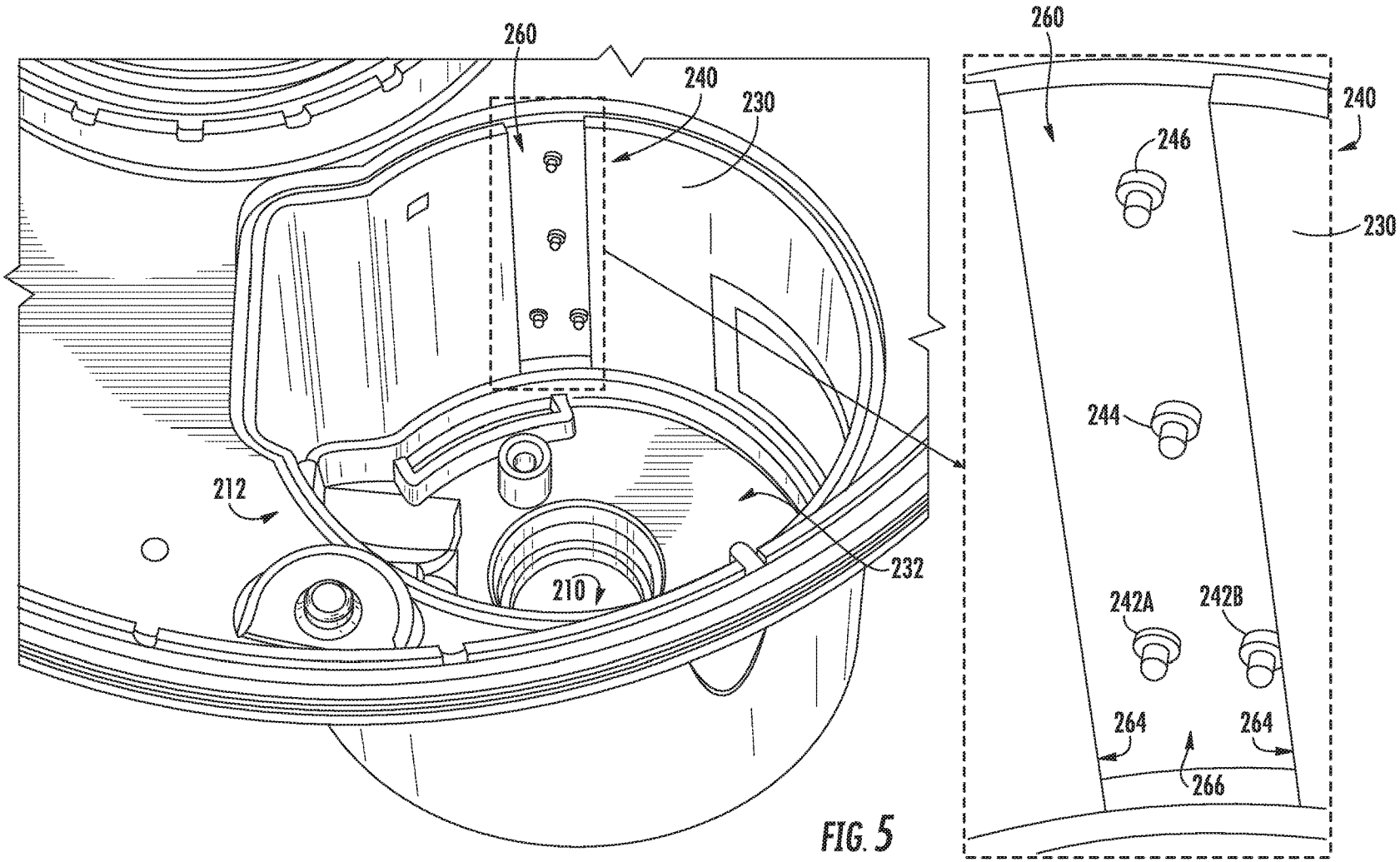
FIG. 5 provides a perspective view of a portion of the tub, including a magnified view of tub receptacle and conductivity sensors, according to an exemplary embodiment of the present disclosure.
Figure 6:
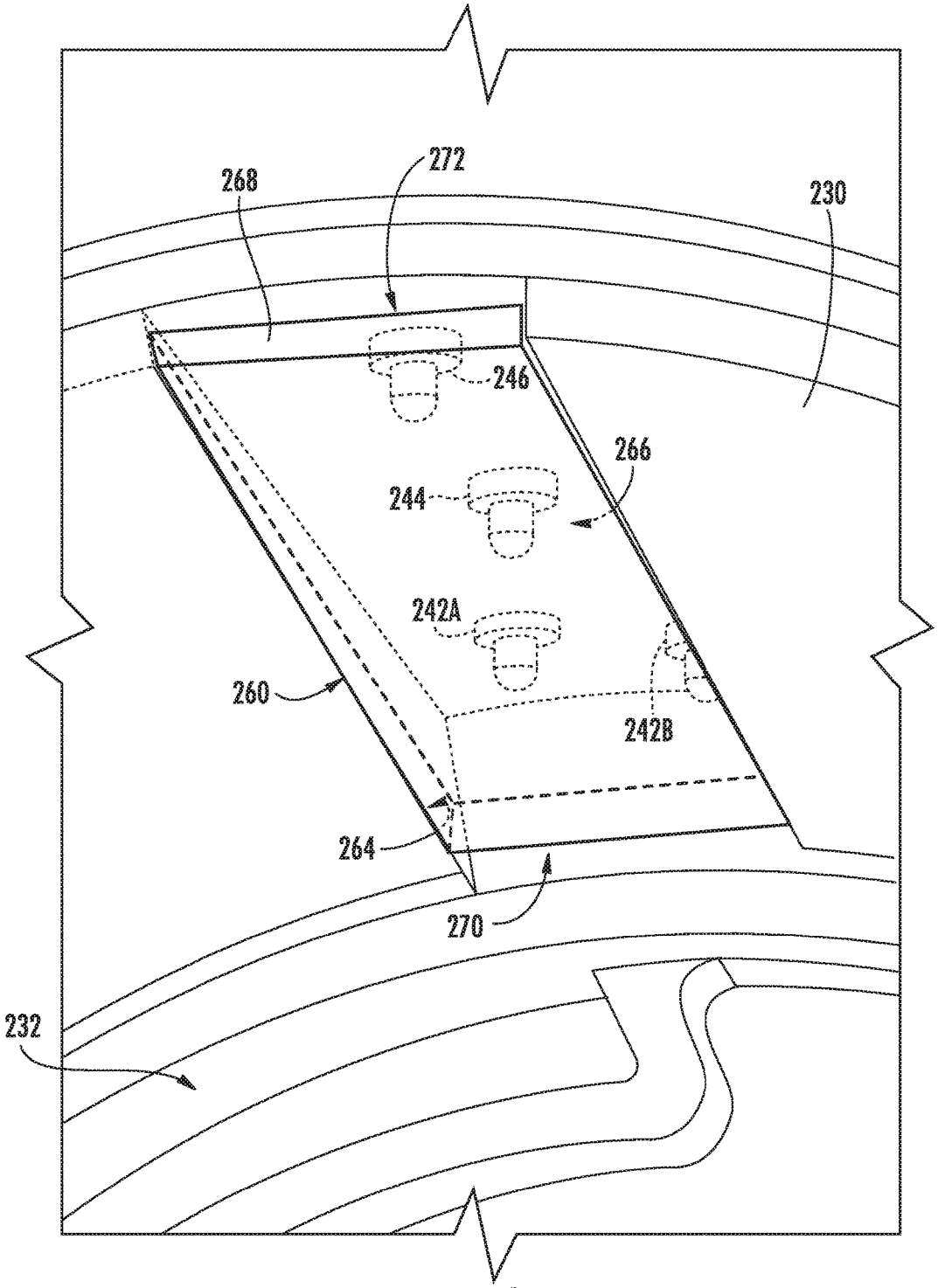
FIG. 6 provides a magnified perspective view of a tub receptacle and conductivity sensors according to another exemplary embodiment of the present disclosure.
Figure 7:
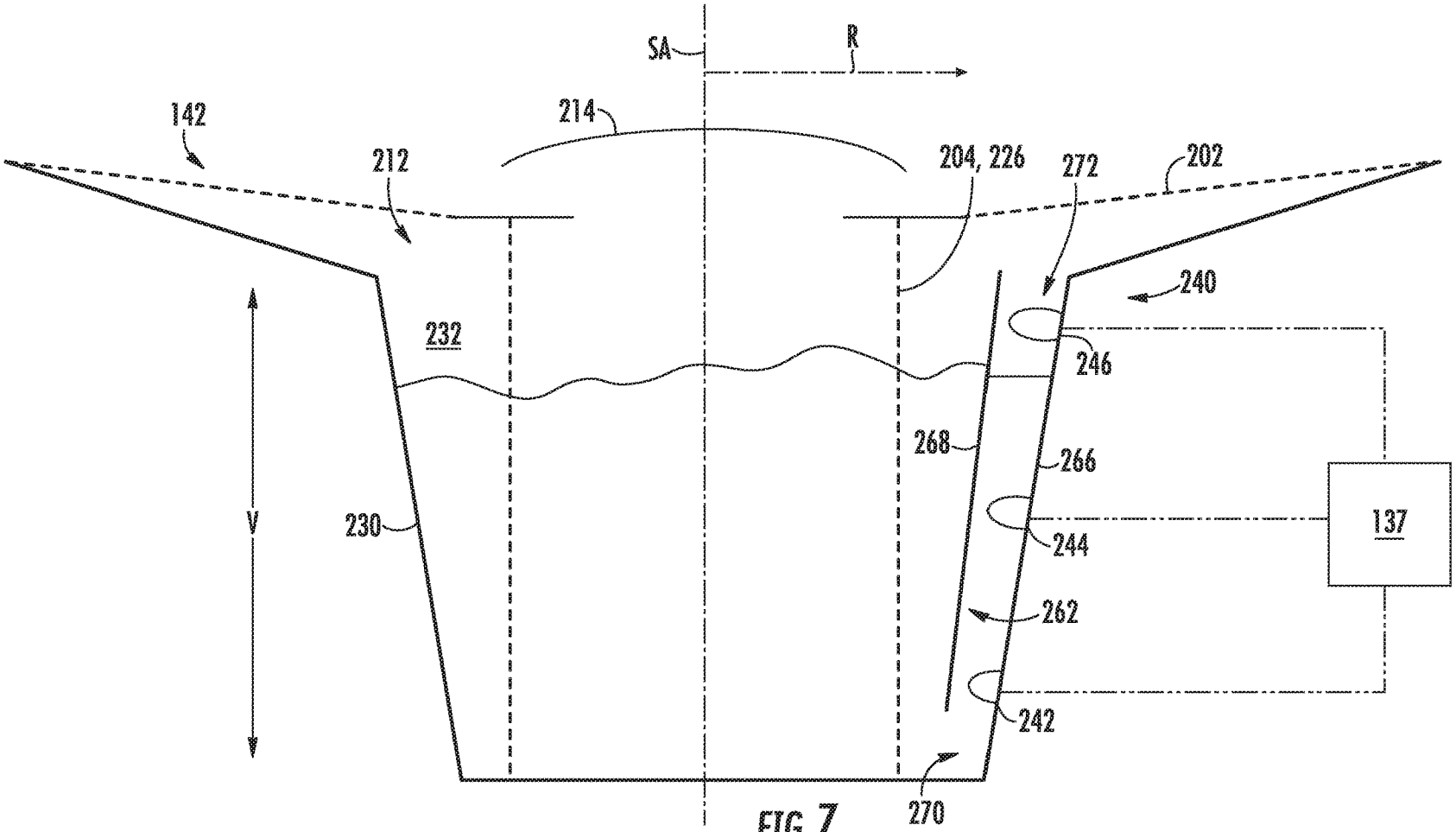
FIG. 7 provides a schematic side view of the exemplary tub receptacle and conductivity sensors of FIG. 6.
Figure 8:
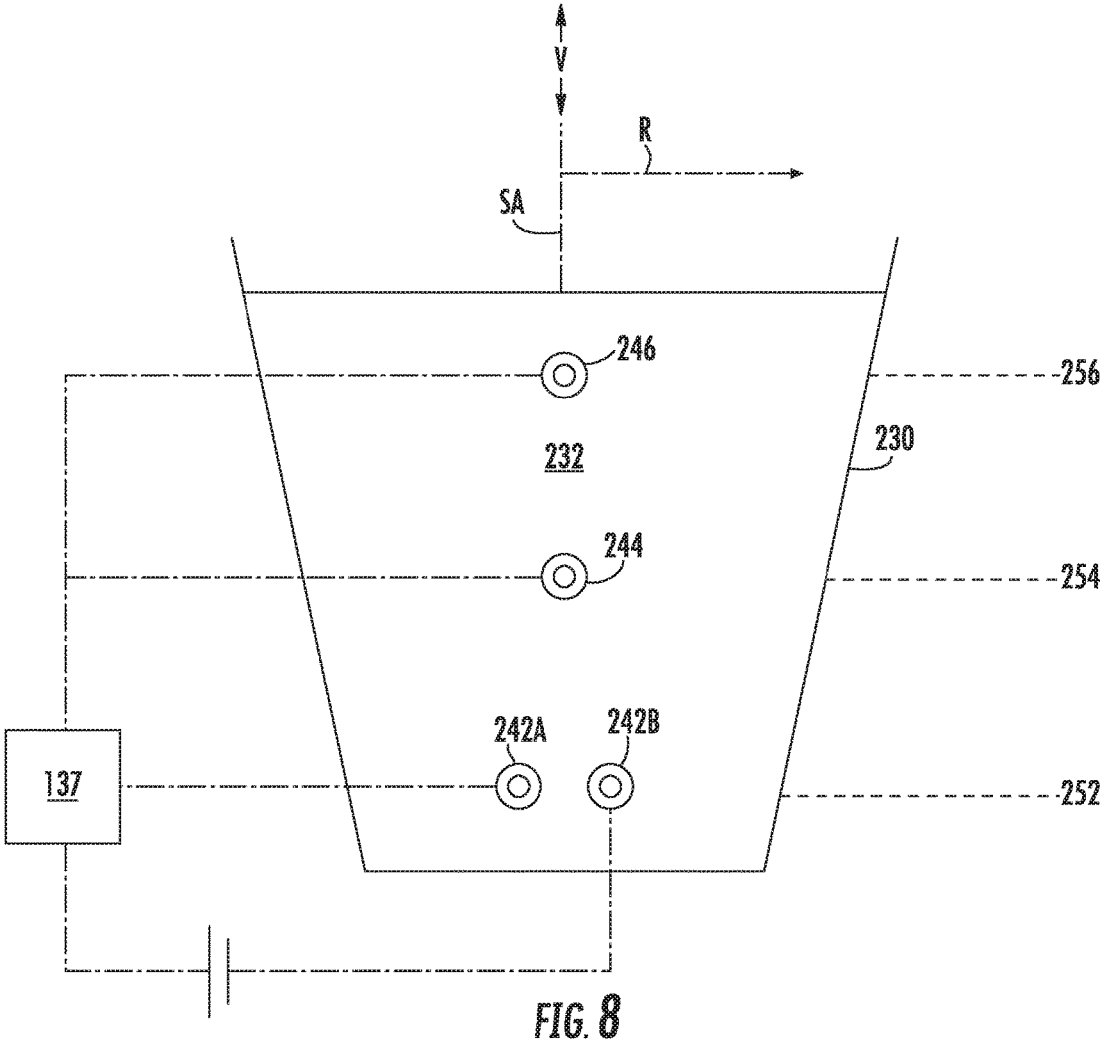
FIG. 8 provides a schematic side view of a tub receptacle and conductivity sensors according to an exemplary embodiment of the present disclosure.
Figure 11:
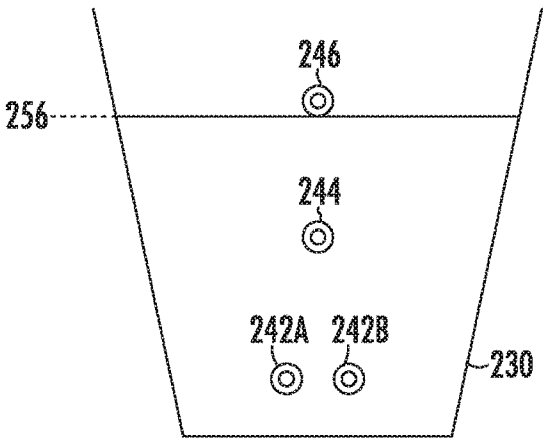
FIG. 11 provides a schematic side view of a tub receptacle and conductivity sensors according to an exemplary embodiment of the present disclosure, wherein a wash fluid is at an upper third level.
Figure 10:
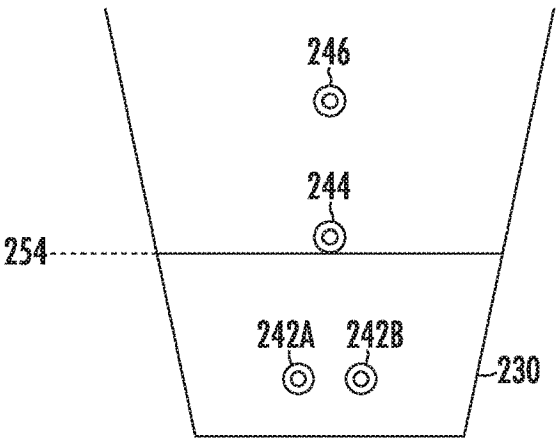
FIG. 10 provides a schematic side view of a tub receptacle and conductivity sensors according to an exemplary embodiment of the present disclosure, wherein a wash fluid is at an intermediate second level.
Figure 9:
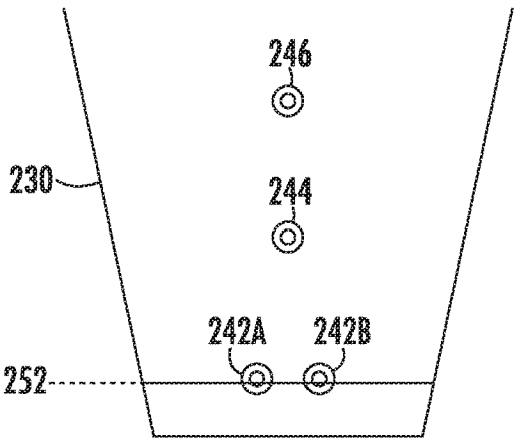
FIG. 9 provides a schematic side view of a tub receptacle and conductivity sensors according to an exemplary embodiment of the present disclosure, wherein a wash fluid is at a lower first level.

Referring now to FIGS. 2, through 4, an exemplary filtering system 200 is provided. As shown, in exemplary embodiments, filtering system 200 is located in the sump portion 142 and provides filtered fluid to the pump inlet 162. Generally, filtering system 200 removes soiled particles from the fluid that is recirculated through the wash chamber 106 during operation of dishwasher appliance 100. In exemplary embodiments, filtering system 200 includes both a first filter 202 (also referred to as a "coarse filter") and a second filter 204 (also referred to as a "fine filter").

In some embodiments, the first filter 202 is constructed as a grate having openings 218 for filtering fluid received from wash chamber 106. The sump portion 142 includes a recessed portion 216 over which the first filter 202 is removably received. In one exemplary embodiment, the first filter 202 operates as a coarse filter having media openings 218 in the range of about 0.030 inches to about 0.060 inches. The recessed portion 216 may define a filtered volume wherein debris or particles have been filtered by the first filter 202 and/or the second filter 204. As shown, pump inlet 162 is defined within recessed portion 216. A recirculation conduit 156 may be disposed in fluid communication with the pump inlet 162 and the recirculation pump 154. During certain operations, wash fluid may selectively flow through pump inlet 162 and recirculation conduit 156 before being motivated, e.g., by the recirculation pump 154, to one or more of lower spray arm assembly 144, mid-level spray-arm assembly 148, or upper spray assembly 150.

The second filter 204 may be non-removable or can be provided as a removable cartridge positioned in a tub receptacle 212 formed in sump portion 142. Specifically, the second filter 204 may be removably positioned within a collection chamber 232 defined by tub receptacle 212. The second filter 204 may be generally shaped to complement tub receptacle 212. For instance, the second filter 204 may include a cylindrical wall 226 that complements a generally cylindrical shape of tub receptacle 212. Alternatively, tub receptacle 212 may have a suitable non-cylindrical shape to receive the second filter 204 and direct fluid to the drain outlet 210 through cylindrical wall 226.

Cylindrical wall 226 may be formed from one or more fine filter media. Some such embodiments may include filter media, e.g., screen or mesh, having pore or hole sizes in the range of about 50 microns to about 600 microns. As illustrated, cylindrical wall 226 may define an internal chamber 224. A top portion 214 of fine filter positioned above internal chamber 224 may define one or more openings 228 permitting fluid to flow into internal chamber 224 without passing through the first filter 202 or the fine filter media of cylindrical wall 226. Top portion 214 may include a handle that allows a user to grasp and remove the second filter 204 for replacement or cleaning. An opening 222 defined through the first filter 202 allows for positioning of the second filter 204 into receptacle 212.

Between openings 228 and drain pump 208, internal chamber 224 defines an unfiltered volume. An exit conduit 209 may be positioned downstream from drain pump 208 in fluid communication with internal chamber 224. As illustrated, exit conduit 209 may extend to a drain outlet 210. During certain operations, debris or particles may pass through openings 228 and into internal chamber 224. When drain pump 208 is activated, fluid and/or particles within internal chamber 224 may be directed through exit conduit 209 and drain outlet 210, flowing wash fluid to an area outside of appliance 100, e.g., an ambient area.

Based on the shape of the sump portion 142 (FIG. 2), during certain operations, e.g., washing or cleaning cycles, fluid flows down along a primary flow direction, e.g., in fluid series from the wash chamber 106 to the recessed portion 216, for filtration in the filtering system 200. After the fluid is filtered by passing through the first filter 202 or the second filter 204 the filtered fluid is fed to the inlet 162 of the recirculation pump 154 for return to the wash chamber 106 by way of fluid circulation assembly 152. Optionally, one or more sensors, e.g., turbidity sensors, may be disposed within fluid circulation assembly 152, e.g., at pump inlet 162, for monitoring a condition of recirculated fluid during operations. After being sprayed onto articles in the dishwasher appliance 100 using one or more of the spray elements 144, 148, and 150, the fluid eventually flows to sump portion 142 and is filtered again. Although a separate recirculation pump 154 and drain pump 208 are described herein, it is understood that other suitable pump configurations, e.g., using only a single pump for both recirculation and draining, may be provided.

Turning to FIGS. 5 through 11, receptacle 212 of the sump portion 142 includes an internal wall 230 defining a collection chamber 232 into which wash fluid may collect. Internal wall 230 may, for instance, define a generally cylindrical or frusto-conical collection chamber 232 above drain outlet 210 in fluid communication with fluid circulation assembly 152 (FIG. 2). Internal wall 230 may generally extend about a sump axis SA defined thereby. Second filter 204 may further extend about the sump axis SA, e.g., at the cylindrical wall 226, when mounted within sump portion 142. In turn, cylindrical wall 226 is positioned radially inward (i.e., closer to sump axis SA along a radial direction R) from internal wall 230.

A fluid sensor assembly 240 is disposed within the sump portion 142 to detect the amount of wash fluid that is and/or will be contained in the sump portion 142. In certain embodiments, a plurality of conductivity sensors 242, 244, 246 is mounted within receptacle 212. At least a portion of each conductivity sensor 242, 244, 246 may be contained within sump portion 142. Specifically, at least a portion of each conductivity sensor 242, 244, 246 may be in fluid communication with collection chamber 232. Each conductivity sensor 242, 244, 246 may further be operably connected (e.g., electrically coupled) to controller 137 to communicate therewith. For instance, conductivity sensors 242, 244, 246 may be operably connected to controller 137 via one or more suitable transmission paths, such as that defined by wire or wireless communications band. Controller 137 and/or conductivity sensors 242, 244, 246 may thus send and/or receive one or more signals therebetween.

In some embodiments, the conductivity sensors 242, 244, 246 are provided at various discrete levels or positions along the vertical direction V. These various levels include a lower or first level 252 as well as one or more elevated levels 254, 256 that are higher along the vertical direction V than the lower or first level 252. In certain embodiments, a base conductivity sensor 242 is mounted at the lower or first level 252, while an elevated conductivity sensor 244 or 246 is mounted at a level 254 or 256 above the first level 252. In optional embodiments, at least one discrete conductivity sensor is provided at each of three different levels 252, 254, 256. For instance, base conductivity sensor 242 is mounted at the lower or first level 252, a middle or elevated conductivity sensor 244 is mounted at an intermediate or second level 254, and a top or additional elevated conductivity sensor 246 is mounted at an upper or third level 256 that is higher than both the first level 252 and second level 254. Optionally, one or more conductivity sensors 242, 244, 246 may include a pair of parallel sensors 242A, 242B. For instance, base conductivity sensor 242 includes a paired first sensor 242A and a paired second sensor 242B, each being mounted at parallel positions along the first level 252. Each parallel sensor of the pair 242A, 242B may be spaced apart (e.g., circumferentially about the sump axis SA) at a predetermined distance such that water contacts each at the same vertical fluid level but does not bridge respective electrodes of the parallel sensors 242A, 242B.

Fluid sensor assembly 240 further provides a sensor enclosure 260 that covers or extends over one or more of conductivity sensors 242, 244, 246. In some such embodiments, sensor enclosure 260 defines a detection cavity 262 in fluid communication with collection chamber 232. For instance, sensor enclosure 260 may include opposing sidewalls 264 and a rear wall 266 that extending radially outward from internal wall 230 of the sump portion 142. Together, sidewalls 264 and rear wall 266 may define detection cavity 262.

A leveling partition 268 may be positioned radially outward from collection chamber 232, e.g., between collection chamber 232 and detection cavity 262. Leveling partition 268 may form a solid barrier spanning at least a portion of opposing sidewalls 264. Wash fluid may thus be prevented or restricted from passing directly through the leveling partition. In some embodiments, sensor enclosure 260 defines a bottom channel 270, e.g., beneath partition and/or between opposing sidewalls 264. Bottom channel 270 may be defined below base conductivity sensor 242 in fluid communication between collection chamber 232 and detection cavity 262.

A vent aperture 272 may further be defined above bottom channel 270. For instance, vent aperture 272 may extend above leveling partition 268, e.g., between opposing sidewalls 264. Moreover, vent aperture 272 may be defined at a position above the uppermost conductivity sensor, e.g., top conductivity sensor 246. Vent aperture 272 may be defined in fluid communication between a portion of the sump 142 and detection cavity 262.

As the volume or height of wash fluid within sump portion 142 rises and/or falls, the level of wash fluid within detection cavity 262 will similarly rise and/or fall. In other words, the level of wash fluid within collection chamber 232 may be substantially the same as the level of wash fluid within detection cavity 262. However, the level of wash fluid within detection cavity 262 may be advantageously isolated from turbulence, e.g., caused by the swirling of water, that would otherwise affect the height of wash fluid within sump portion 142 and complicate the detection of a fluid level.

As noted above, a plurality of conductivity sensors 242, 244, 246 may be provided at various levels 252, 254, 256. In some embodiments, the conductivity sensors 242, 244, 246 are mutually connected to detect variations in conductivity across fluid sensor assembly 240. A change in conduction, e.g., such as that causes by wash fluid spanning the distance between two or more of conductivity sensors 242, 244, 246, may cause an electrical conduction circuit to be completed. In turn, completion of the circuit may generate a signal indicating detection of a specific level of wash fluid at a given moment. For instance, completion of the circuit between the pair of parallel sensors 242A, 242B of base conductivity sensor 242 may indicate detection of wash fluid at the first level 252; completion of the circuit between base conductivity sensor 242 and middle conductivity sensor 244 may indicate detection of wash fluid at the second level 254; and completion of the circuit between base conductivity sensor 242 and top conductivity sensor 246 may indicate detection of wash fluid at the third level 256

As described above, each conductivity sensor 242, 244, 246 may be connected to the controller 137. Optionally, the controller 137 can receive a unique signal in response to the completion or break of each conduction circuit. In some embodiments, controller 137 is configured to determine a volumetric flow rate for wash fluid based on one or more received signals from the plurality of conductivity sensors 242, 244, 246.

As an example, when wash fluid is supplied to wash chamber 106, controller 137 may measure a time period between the moment a signal is received from base conductivity sensor 242 (e.g., when the conduction circuit is completed at base conductivity sensor 242) and the moment a signal is received from one of the elevated conductivity sensors 244, 246, (e.g., when the conduction circuit is completed between base conductivity sensor 242 and elevated conductivity sensor 244 or 246). As an additional or alternative example, when wash fluid is being drained from wash chamber 106, e.g., through drain outlet 210 via pump(s) 152, 208 (FIG. 2), the controller 137 may measure a time period between the moment a signal is received from top conductivity sensor 246 (e.g., when the conduction circuit between top conductivity sensor 246 and base conductivity sensor 242 is broken) and the moment a signal is received from middle conductivity sensor 244 (e.g., when the conduction circuit between top conductivity sensor 246 and base conductivity sensor 242 is broken). Each level 252, 254, 256 of sensors 242, 244, 246 may correspond to a known fluid volume (e.g., of collection chamber 232), so the measured time period may be used to determine the change in fluid volume over time, i.e., the volumetric flow rate.

Figure 3:
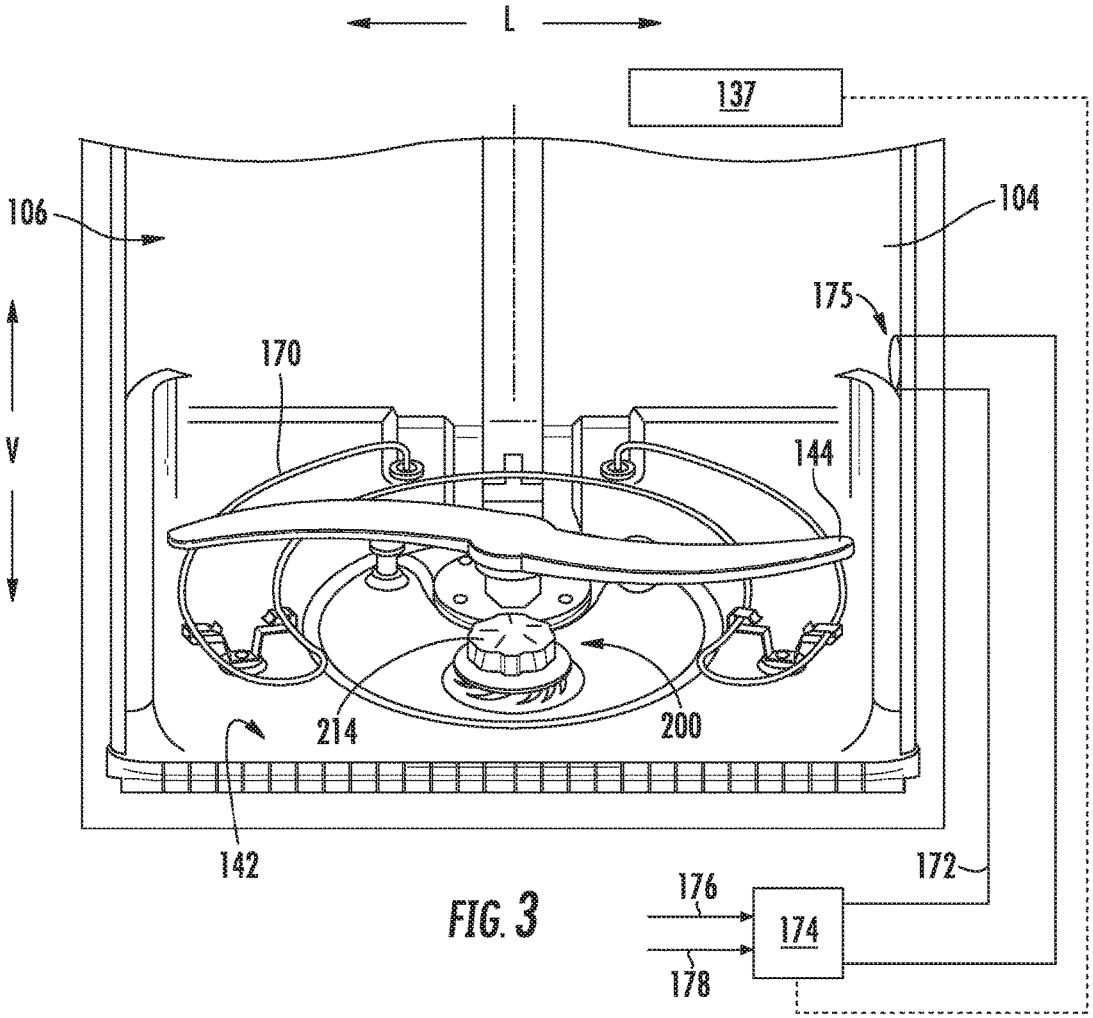
FIG. 3 provides a front perspective view an internal portion of the exemplary dishwasher appliance of FIG. 2, wherein a grate or coarse filter has been removed to reveal a recess in a sump portion of a wash chamber.

In some embodiments, controller 137 is further configured to adjust or change an operational setting according to received signals. As an example, controller 137 may initiate a valve closure, e.g., at water supply valve 174 (FIG. 3), in response to receiving a signal from one or more of the conductivity sensors 242, 244, 246. Optionally, controller 137 may initiate closing of supply valve 174 to terminate the flow of wash fluid therethrough once a signal has been received from the top conductivity sensor 246. As an additional or alternative example, controller 137 may deactivate pump(s) 152, 208 (FIG. 2) to halt or terminate draining in response to receiving a signal, e.g., indicating a break in conductivity, from one or more of the conductivity sensors 242, 244, 246. Optionally, controller 137 may deactivate pump(s) 152, 208 in response to receiving a signal from base conductivity sensor 242 (e.g., when the conduction circuit between the pair of parallel sensors 242A, 242B is broken).

In additional or alternative embodiments, the controller 137 is configured to adjust or change an operational setting based specifically on the determined volumetric flow rate. For instance, a fill point or target point for when a desired wash fluid volume will be reached may be calculated. The controller 137 may adjust (e.g., increase or decrease) the flow of wash fluid to/from the wash chamber 106 according to the fill point and/or target point. Optionally, the controller 137 may permit filling or draining to occur only up until the fill point or target point is met.

Figure 12:
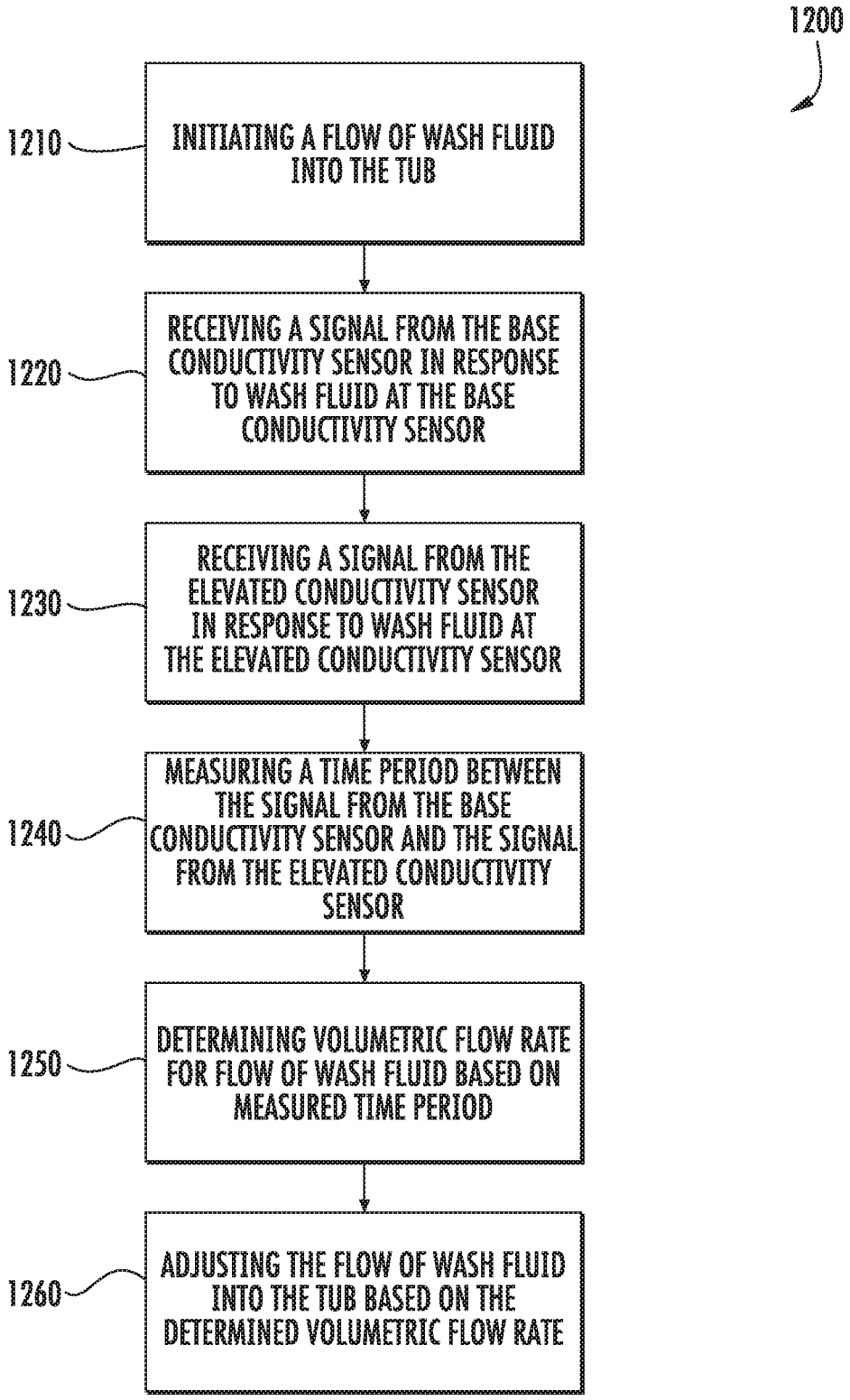
FIG. 12 provides a flow chart of a method of operating a dishwashing appliance, according to an exemplary embodiment of the present disclosure.
Figure 13:
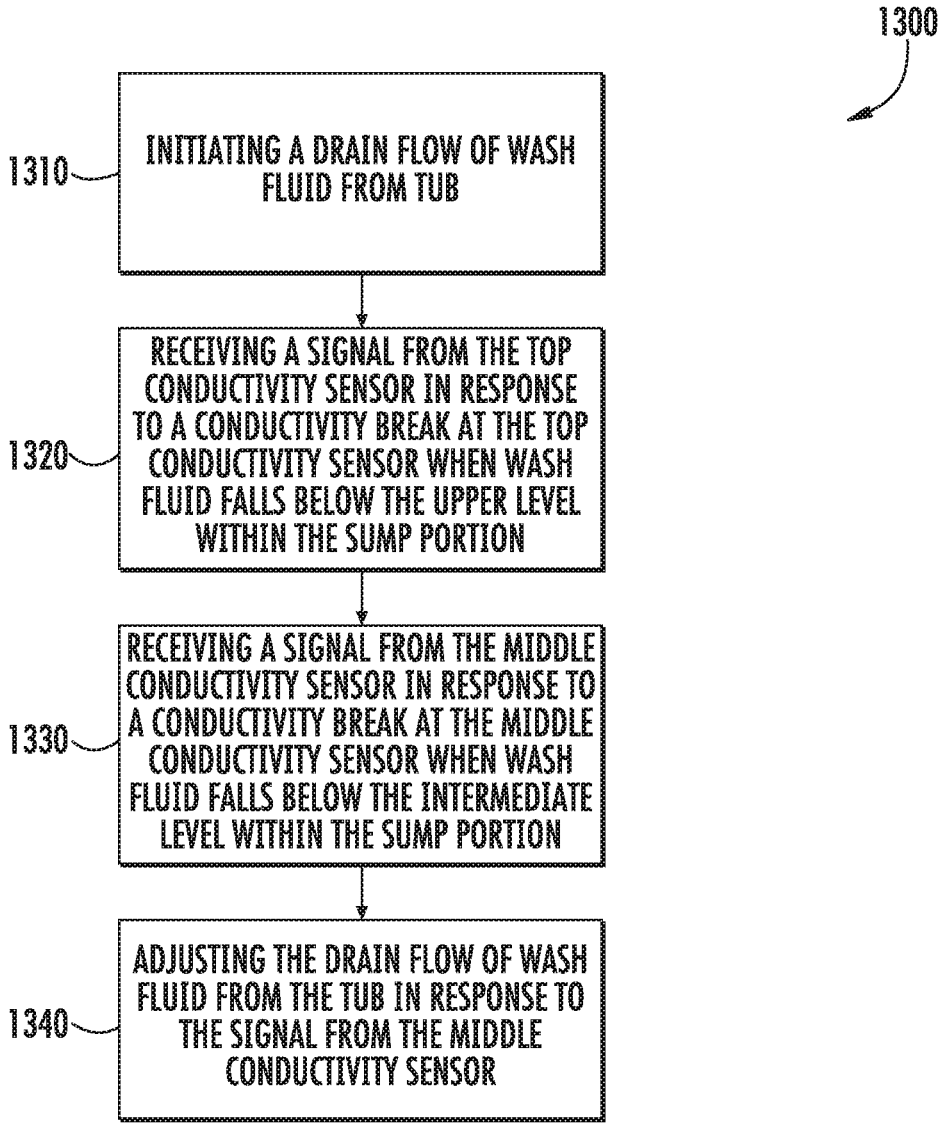
FIG. 13 provides a flow chart of a method of operating a dishwashing appliance, according to an exemplary embodiment of the present disclosure.
Figure 14:
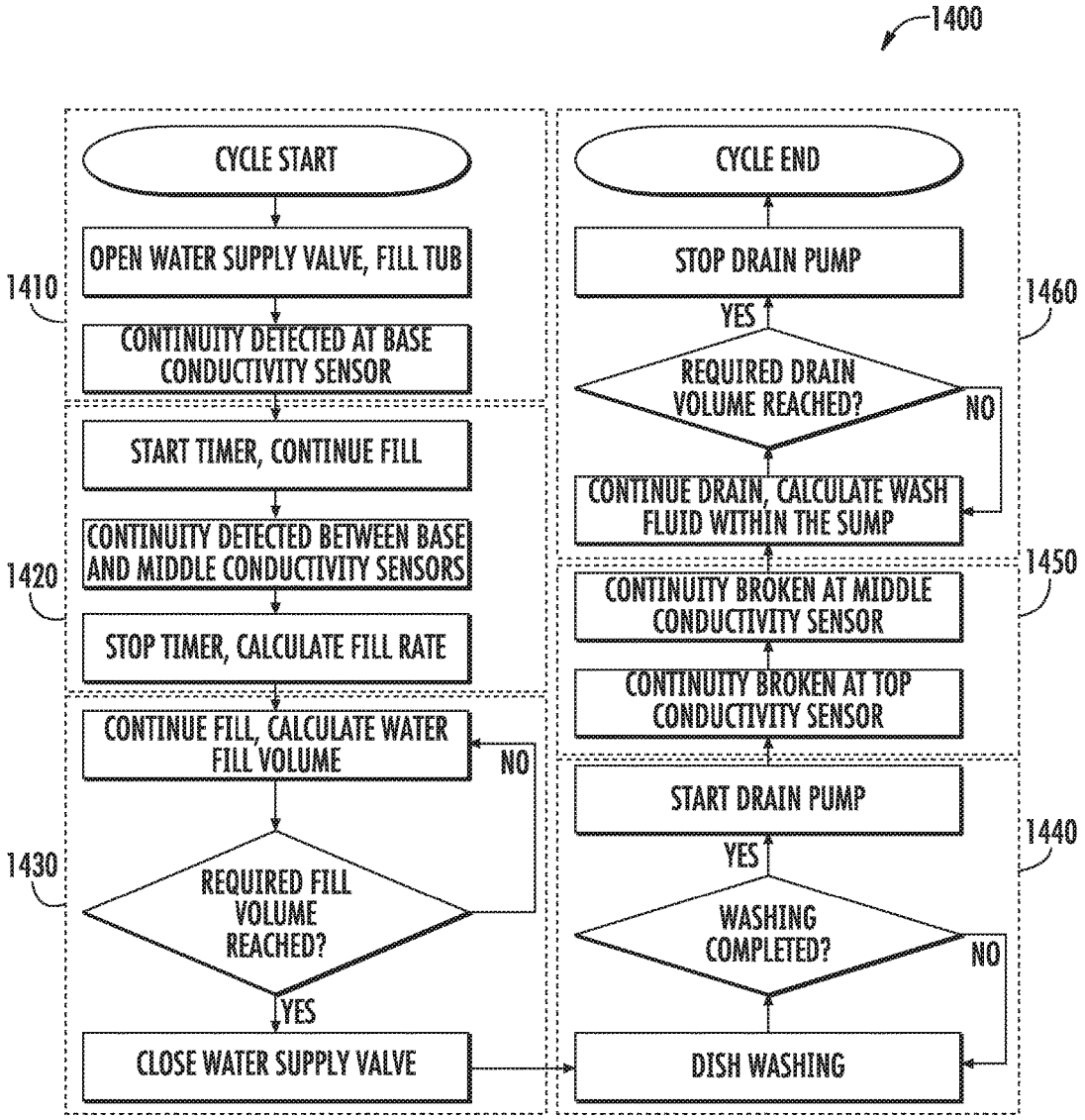
FIG. 14 provides a flow chart of a method of operating a dishwashing appliance, according to an exemplary embodiment of the present disclosure.

Turning now to FIGS. 12 through 14, various methods 1200, 1300, and 1400 for operating a dishwashing appliance are illustrated. Methods 1200, 1300, and 1400 may be used to operate any suitable dishwashing appliance. As an example, some or all of methods 1200, 1300, and 1400 may be used to operate dishwashing appliance 100 (FIG. 1). The controller 137 (FIG. 2) may be programmed to implement some or all of methods 1200, 1300, and 1400.

Turning specifically to FIG. 12, method 1200 may include, at 1210, initiating a flow of wash fluid into a tub, e.g., within a wash chamber, of the dishwashing appliance. In some embodiments, water is supplied to the wash chamber through a water supply valve, as described above. For instance, the water supply valve may be opened to permit the flow of water into tub, including a sump portion.

At 1220, the method 1200 may include receiving a signal from a base conductivity sensor in response to wash fluid at the base conductivity sensor. The signal may indicate detection of a wash fluid at a base conductivity sensor. As described above, the base conductivity sensor may include two parallel sensors. Wash fluid within the sump at the level of the base conductivity sensor may form an electrical circuit connecting the two parallel sensors. In turn, 1220 may include detecting conductivity between the two parallel sensors e.g., continuity of the circuit between the two parallel circuits.

At 1230, the method 1200 may include receiving a signal from an elevated conductivity sensor in response to wash fluid at the elevated conductivity sensor. The signal may indicate detection wash fluid at the elevated conductivity sensor. Wash fluid spanning the vertical distance between the base conductivity sensor and the elevated conductivity sensor may form an expanded electrical circuit. In other words, a circuit connecting the base conductivity sensor and the elevated conductivity sensor. In some embodiments, 1230 includes detecting conductivity between the base conductivity sensor and the elevated conductivity sensor, e.g., continuity of the expanded circuit between the base conductivity sensor and the elevated conductivity sensor.

At 1240, the method 1200 may include measuring a time period between the signal from the base conductivity sensor and the signal from the elevated conductivity sensor, e.g., measuring the time period between 1220 and 1230. For instance, a timer may be started once wash fluid is detected at the base conductivity sensor. The timer may be subsequently stopped once wash fluid is detected at the elevated conductivity sensor. The measured time may be the recorded time period between the moment the timer was started and the moment the timer was stopped, which generally corresponds to the time taken for wash fluid to rise from the base conductivity sensor to the elevated conductivity sensor.

At 1250, the method 1200 may include determining a volumetric flow rate for the flow of wash fluid based on the measured time period. The appliance may include predetermined information regarding the volume of the sump portion of the dishwashing appliance. For instance, a controller may store a predetermined volume of the dishwashing appliance for the sump portion that is below the level at which the base conductivity sensor is mounted. The controller may also store predetermined volumes for the sump portions that are below each of the elevated conductivity sensor and the additional conductivity sensor. The determined volumetric flow rate may be calculated as the total volume that is filled over the measured time period.

At 1260, the method 1200 may include adjusting the flow of wash fluid into the tub based on the determined volumetric flow rate. For instance, a baseline volumetric flow rate may be included with the appliance (e.g., stored within controller) for comparison to the determined volumetric flow rate. In some embodiments, if the baseline volumetric flow rate is below the desired volumetric flow rate, the time during which water supply valve remains open may be increased. If the determined volumetric flow rate is above the baseline volumetric flow rate, the time during which water supply valve remains open may be decreased. In additional or alternative embodiments, if the baseline volumetric flow rate is below the desired volumetric flow rate, the opening of water supply valve may be increased. If the determined volumetric flow rate is above the baseline volumetric flow rate, the opening of water supply valve may be decreased. The flow of wash fluid into the tub may be halted or terminated. Optionally, 1260 may include terminating, e.g., immediately terminating, the flow of wash fluid in response to receiving a signal from an additional elevated conductivity sensor indicating wash fluid.

In certain embodiments, the method 1200 further includes calculating a fill time for when a desired wash fluid volume will be reached within the tub based on the determined volumetric flow rate. For example, the fill time may be a future time or period of time at which the desired wash fluid volume will be reached if the determined volumetric flow rate remains constant. Flow of wash fluid into the tub may be terminated at the expiration of the target point. Advantageously, over-filling of the sump portion may thus be prevented.

In further optional embodiments, the method 1200 includes receiving a signal from an additional elevated conductivity sensor in response to wash fluid at the additional elevated conductivity sensor, as described above. The method 1200 may include measuring a new time period between the signal from the elevated conductivity sensor and the signal from the additional elevated conductivity sensor, as described above. Based on the new time period, the method 1200 may include determining a revised volumetric flow rate for the flow of wash fluid. Subsequently, the method 1200 may provide for adjusting the flow of wash fluid into the tub based on the revised volumetric flow rate.

Turning specifically to FIG. 13, method 1300 may include, at 1310, initiating a drain flow of wash fluid from the tub. In some embodiments, wash fluid is drained from the wash chamber through one or more pumps, as described above. For instance, a pump may be activated to force the flow of wash fluid through and from the sump portion.

At 1320, the method 1300 may include receiving a signal from the top conductivity sensor in response to a conductivity break at the top conductivity sensor when wash fluid falls below an upper level within the sump portion. As described above, a circuit may be initially formed by the wash fluid extending from the top conductivity sensor to the base conductivity sensor. When the wash fluid falls below the top conductivity sensor, i.e., below the upper level at which the top conductivity sensor is mounted, the circuit between the top conductivity sensor and the base conductivity sensor will be broken. The controller may be configured to detect such a break in conductivity, e.g., the moment at which the conductivity between the top circuit and the base circuit no longer exists. Although the circuit between the top conductivity sensor and the base conductivity sensor is broken, the circuit between the middle conductivity sensor and the base conductivity sensor may be detected.

At 1330, the method 1300 may include receiving a signal from a middle conductivity sensor in response to a conductivity break at the middle conductivity sensor when wash fluid falls below an intermediate level within the sump portion. When the wash fluid falls below the middle conductivity sensor, i.e., below the intermediate level at which the top conductivity sensor is mounted, the circuit between the middle conductivity sensor and the base conductivity sensor will be broken. The controller may be configured to detect such a break in conductivity, e.g., the moment at which the conductivity between the middle circuit and the base circuit no longer exists. Although the circuit between the middle conductivity sensor and the base conductivity sensor is broken, the circuit at the base conductivity sensor may be detected, e.g., the circuit between two parallel sensors.

In optional embodiments, the method 1300 may further include measuring a time period between 1310 and 1320. For instance, a timer may be started once a circuit between the top conductivity sensor and the base sensor is broken. The timer may be subsequently stopped once a circuit between the middle conductivity sensor and the base conductivity sensor is broken. The measured time may be the recorded time period between the moment the timer was started and the moment the timer was stopped, which generally corresponds to the time taken for wash fluid to fall from the top conductivity sensor to the middle conductivity sensor.

Further embodiments of the method 1300 may include determining a volumetric flow rate for the drain flow of wash fluid based on the measured time period. The dishwashing appliance may include predetermined information regarding the volume of the sump portion of the dishwashing appliance. For instance, a controller may store a predetermined volume of the dishwashing appliance for the sump portion that is below the level at which the base conductivity sensor is mounted. The controller may also store predetermined volumes for the sump portions that are below each of the elevated conductivity sensor and the additional conductivity sensor. The determined volumetric flow rate may be calculated as the volume that is drained over the measured time period.

At 1340, the method 1300 may include adjusting the drain flow of wash fluid from the tub in response to the signal from the middle conductivity sensor, e.g., 1330. For instance, 1340 may include deactivating a pump to stop draining wash fluid at the moment the circuit between the middle conductivity sensor and the base conductivity sensor is broken. Additionally or alternatively, 1340 may include changing an operational speed of the pump such that the rate of drain flow is increased or decreased.

In some embodiments, the method 1300 includes adjusting the drain flow of the dishwashing appliance according to the determined volumetric flow rate. The method 1300 may include calculating a target point for when a desired wash fluid volume will be reached within the tub, e.g., at the sump portion, based on the determined volumetric flow rate. For instance, the target point may be an estimated time period at which the wash fluid will be substantially drained from the tub. Alternatively, the target point may be an estimated time period at which only a select amount of wash fluid remains within the tub. Adjusting the drain flow may include deactivating the pump according to the target point, e.g., at the moment at which the estimated time period expires.

Additionally or alternatively, adjusting the drain flow of method 1300 may include deactivating the pump when no water is detected in the sump portion of the tub. In other words, when an absence of water is detected within the sump portion of the tub. The pump may be deactivated after a predetermined time period once a signal is received from the base sensor. For instance, once a circuit at the base sensor is broken. Alternatively, the pump may be deactivated immediately once a signal is received from the base sensor. Optionally, detecting an absence of water may override or supersede deactivation based on the target point.

Turning specifically to FIG. 14, method 1400 may provide a discrete cleaning cycle to be performed. Optionally, the method 1400 may be initiated, for example, in response to received input signal provided by a user at the user interface of an appliance.

At 1410, the method 1400 may include initiating a water flow into the wash chamber of a dishwashing appliance. A water supply valve may be opened and wash fluid may begin filling a tub, e.g., in a sump portion of the dishwasher appliance. Once a certain volume of wash fluid fills the tub, continuity (e.g., a continuous circuit) may be detected at a base conductivity sensor a between a pair of parallel sensors, as described above.

At 1420, the method 1400 may include determining a fill rate. Optionally, 1420 may occur in response to 1410 being completed. At 1420, a timer may be started. Once a certain increased volume of wash fluid fills the tub, continuity (e.g., a continuous circuit) may be detected between the base conductivity sensor and a middle conductivity sensor. The timer may be stopped in response to continuity between all three conductivity sensors. A fill rate may be calculated based on the time measured, e.g., volume filled over the time measured.

At 1430, the method 1400 may include directing a required fill volume of wash fluid to the wash chamber based on the determined fill rate. Optionally, the required fill volume may be calculated as a function of time and the determined fill rate. Wash fluid may be steadily supplied to tub, e.g., through water supply valve, until the required fill volume is reached. Once the required fill volume is reached, the water supply valve may be closed.

At 1440, the method 1400 may include initiating a wash operation. The wash operation may start washing dishes within the tub and continue until it is determined that washing is complete. Once washing is determined to be complete, 1440 may include starting or activating a drain pump.

At 1450, the method 1400 may include determining a drain rate. A continuous circuit may be detected between a top conductivity sensor and the base conductivity sensor, as described above. Once the continuity or continuous circuit is broken at the top conductivity sensor, the timer may be started to measure a drain time. The timer may be subsequently stopped once the continuity or continuous circuit is broken at the middle conductivity sensor. A drain rate may be calculated for the volume of water drained between the top and middle conductivity sensors over the drain time measured by the timer.

At 1460, the method 1400 may include draining a required volume of wash fluid (e.g., the remaining volume of wash fluid) from the sump. Optionally, the required drain volume may be calculated as a function of time and the determined drain rate. Wash fluid may be steadily removed from tub, e.g., through drain pump, until the required drain volume is reached. Once the required fill volume is reached, draining may be terminated. The drain pump may be stopped or deactivated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a vertical direction, the dishwashing appliance comprising:

a tub that defines a wash chamber for receipt of articles for washing;

a sump positioned at a bottom portion of the tub along the vertical direction, the sump including an internal wall defining a collection chamber;

a fluid circulation assembly for providing a flow of wash fluid within the wash chamber; and a fluid sensor assembly disposed within the sump, the fluid sensor assembly comprising an isolated sensor enclosure defining a detection cavity in fluid communication with the collection chamber, a base conductivity sensor mounted at a first level within the isolated sensor enclosure, and an elevated conductivity sensor mounted at a second level within the isolated sensor enclosure, the second level being higher along the vertical direction than the first level, wherein the base conductivity sensor comprises a pair of parallel sensors spaced apart at the first level to selectively close a conduction circuit through water at the first level, wherein the isolated sensor enclosure comprises a leveling partition positioned radially outward from a rear wall of the collection chamber between the collection chamber and the detection cavity, wherein the leveling partition extends between a pair of opposing sidewalls, wherein the leveling partition is vertically spaced apart from a bottom wall of the sump such that a bottom channel is defined therebetween, wherein the bottom channel is defined in fluid communication between the collection chamber and the detection cavity, wherein the bottom channel is defined at a position below the base conductivity sensor, wherein the isolated sensor enclosure further defines a vent aperture extending in fluid communication between the sump and the detection cavity, and wherein the vent aperture is defined between a rear wall of the detection cavity and the leveling partition directly above the elevated conductivity sensor.

2. The dishwashing appliance of claim 1, further comprising:

an additional elevated conductivity sensor mounted at a third level within the isolated sensor enclosure, the third level being higher along the vertical direction than the second level.

3. The dishwashing appliance of claim 1, further comprising:

a controller operably connected to the fluid circulation assembly and the fluid sensor assembly, the controller configured for:

receiving a signal from the base conductivity sensor in response to wash fluid at the base conductivity sensor, receiving a signal from the elevated conductivity sensor in response to wash fluid at the elevated conductivity sensor, measuring a time period between the signal from the base conductivity sensor and the signal from the elevated conductivity sensor, determining a volumetric flow rate for the flow of wash fluid based on the measured time period, and adjusting the flow of wash fluid based on the determined volumetric flow rate.

4. The dishwashing appliance of claim 3, wherein the controller is further configured for:

calculating a fill time for the tub based on the determined volumetric flow rate.

5. The dishwashing appliance of claim 4, wherein adjusting the flow of wash fluid comprises terminating the flow of wash fluid after the fill time.

6. The dishwashing appliance of claim 3, wherein receiving the signal from the base conductivity sensor comprises detecting wash fluid at the base conductivity sensor by detecting conductivity between the pair of parallel sensors.

7. The dishwashing appliance of claim 3, wherein receiving the signal from the elevated conductivity sensor comprises detecting wash fluid at the elevated conductivity sensor by detecting conductivity between the base conductivity sensor and the elevated conductivity sensor.

8. The dishwashing appliance of claim 3, further comprising an additional elevated conductivity sensor mounted at a third level within the tub, the third level being higher along the vertical direction than the second level, wherein the controller is further configured for:

receiving a signal from the additional elevated conductivity sensor in response to wash fluid at the additional elevated conductivity sensor.

9. The dishwashing appliance of claim 8, wherein the controller is further configured for:

measuring a second time period between the signal from the elevated conductivity sensor and the signal from the additional elevated conductivity sensor;

determining a revised volumetric flow rate for the flow of wash fluid based on the measured second time period; and adjusting the flow of wash fluid into the tub based on the revised volumetric flow rate.

10. The dishwashing appliance of claim 9, wherein the controller is further configured for:

terminating the flow of wash fluid in response to the signal from the additional elevated conductivity sensor.

* * * * *